United States Patent [19]

Nomura

[11] 4,260,337

[45] Apr. 7, 1981

[54] SWASH PLATE COMPRESSOR

[75] Inventor: Hiroshi Nomura, Konan, Japan

[73] Assignee: Diesel Kiki Company, Ltd., Tokyo, Japan

[21] Appl. No.: 6,783

[22] Filed: Jan. 26, 1979

[30] Foreign Application Priority Data

Jan. 31, 1978 [JP] Japan ..... 53/10888[U]
Mar. 25, 1978 [JP] Japan ..... 53/38758[U]

[51] Int. Cl.[3] ..... F04B 1/14
[52] U.S. Cl. ..... 417/269
[58] Field of Search ..... 417/269

[56] References Cited

U.S. PATENT DOCUMENTS

| | | | |
|---|---|---|---|
| 3,215,341 | 11/1965 | Francis | 417/269 |
| 3,552,886 | 1/1971 | Olson, Jr. | 417/269 |
| 3,904,320 | 9/1975 | Kishi et al. | 417/269 |

*Primary Examiner*—William L. Freeh
*Attorney, Agent, or Firm*—David G. Alexander

[57] ABSTRACT

A drive shaft (17) is rotatably supported in a cylinder (12) by means of bearings (28), (29). A swash plate (24) fixed to the shaft (17) causes a piston (33) to reciprocate in a bore (18), (23) of the cylinder (12) upon rotation of the drive shaft (17) and swash plate (24). The piston (33), in combination with inlet (113) and outlet (58) valves communicating with the cylinder bore (18), (23) cause refrigerant fluid or the like to be compressively displaced through the bore (18), (23) and compressor (11). Passageways (123), (124) connect the cylinder bore (18), (23) to the bearings (28), (29) in such a manner that lubricant oil entrained in the refrigerant is forced by refrigerant pressure in the bore (18), (23) through the passageways (123), (124) to positively lubricate the bearings (28), (29) even during startup of the compressor (11).

4 Claims, 11 Drawing Figures

SWASH PLATE COMPRESSOR

BACKGROUND OF THE INVENTION

The present invention relates to a swash plate compressor of the type disclsed in copending U. S. patent application Ser. No. 949,000, filed Oct. 5, 1978 which is assigned to the same assignee as this application.

The present type of compressor generally includes a cylinder which is formed with a plurality of axial bores. Double acting pistons are slidably disposed in the bores. A swash plate diagonally mounted on a shaft is connected to the pistons in such a manneer that rotation of the shaft and swash plate causes reciprocation of the pistons to compressively displace a fluid. Swash plate compressors are often used as refrigerant compressors for automotive air conditioning systems and the like.

In order to lubricate the swash plate, pistons etc. a lubricant chamber or sump is generally provided in the lower portion of the cylinder containing oil in which the swash plate is partially immersed. The swash plate spashes the oil onto the internal components of the compressor to provide lubrication.

The splash lubrication system is generally superior to a forced lubrication system which requires a separate oil pump, which is typically of the trochoidal type, since a separate oil pump adds to the mechanical complexity and cost of the compressor. However, a problem has existed heretofore in lubrication of the bearings which support the swash plate and drive shaft.

Such lubrication has generally been effected by means of oil entrained in the refrigerant fluid which is forced into the spaces between the shaft and bearings due to pressure created in the swash plate chamber during operation of the compressor. However, the pressure is insufficient during startup of the compressor to provide sufficient lubrication. This underlubrication, especially during the severe conditions of startup, often cause the shaft to score the bearings or even seize.

An attempt to overcome this problem, which constitutes the closest known prior art, is disclosed in U. S. Pat. No. 3,801,227. The prior art system connects an inlet chamber to the bearings through passageways. Oil separated from the refrigerant fluid in the inlet chamber flows down through the passageways to lubricate the bearings.

However, this prior art system does not completely solve the problem since the vacuum in the inlet chamber works against the gravity flow of oil through the passageways and results in insufficient lubrication of the bearings.

SUMMARY OF THE INVENTION

A compressor embodying the present invention includes a cylinder formed with a bore, a piston slidably disposed in the bore, bearing means disposed in the cylinder, a shaft rotatably supported in the cylinder by the bearing means and mechanism means connecting the shaft to the piston in such a manner that rotation of the shaft causes reciprocation of the piston and a passageway connecting the bore to the bearing means.

It is an object of the present invention to provide a swash plate compressor comprising improved means for lubricating drive shaft bearings thereof.

It is another object of the present invention to provide a swash plate compressor constructed in a novel manner such as to positively present scoring and seizing of drive shaft bearings under all operating conditions including startup of the compressor.

It is another object of the present invention to provide an improved swash plate compressor which may be constructed more easily and at lower cost on a commercial production basis than comparable compressors known heretofore.

It is another object of the present invention to provide a generally improved swash plate compressor.

Other objects, together with the foregoing, are attained in the embodiments described in the following description and illustrated in the accompanying drawing.

DESCRIPTION OF THE PREFERRED EMBODIMENTS

While the swash plate compressor of the present invention is susceptible of numerous physical embodiments, depending upon the environment and requirements of use, substantial numbers of the herein shown and described embodiments have been made, tested and used, and all have performed in an eminently satisfactory manner.

Figure 1:
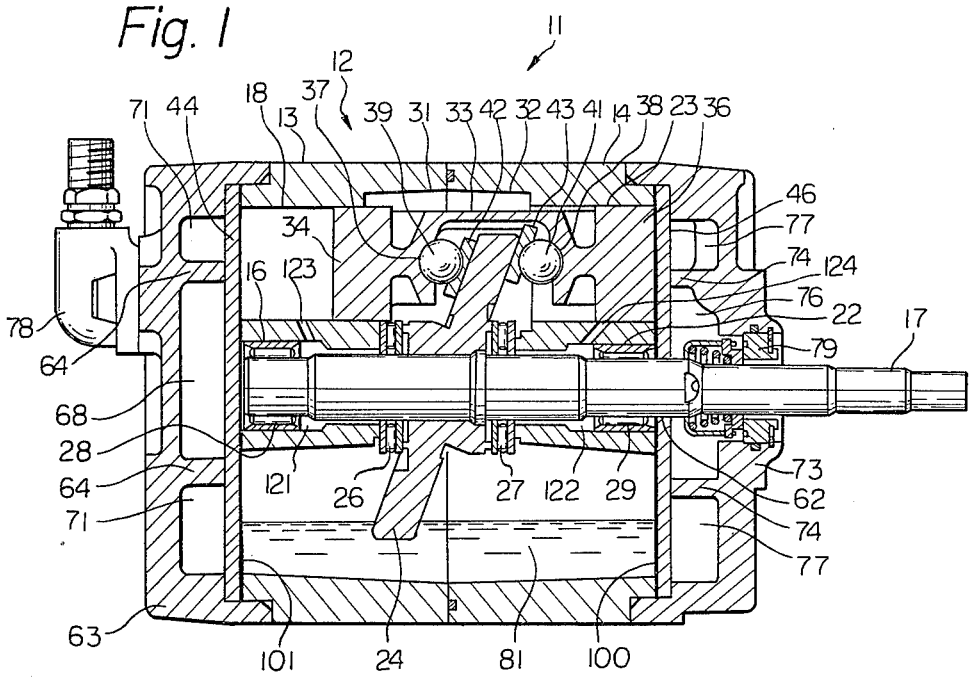
FIG. 1 is a longitudinal sectional view of a swash plate compressor embodying the present invention.
Figure 2:
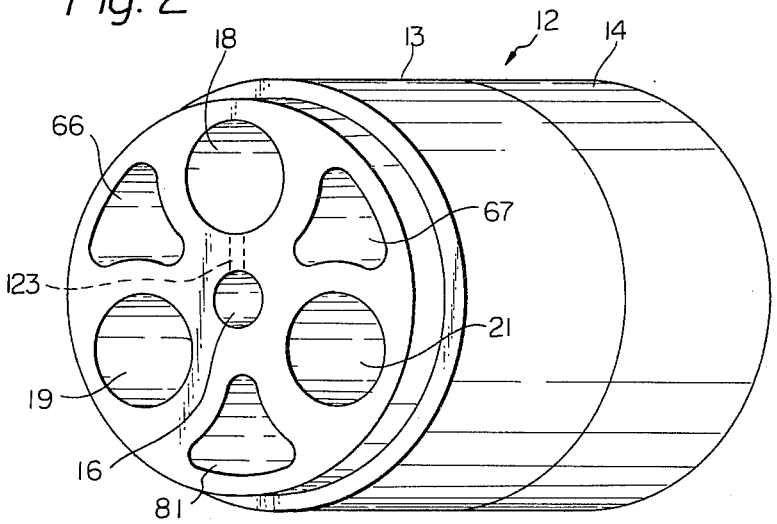
FIG. 2 is a perspective view of a cylinder of the compressor.

Referring now to FIG. 1 of the drawing, a swash plate compressor embodying the present invention is generally designated by the reference numeral 11 and comprises a circular cylinder 12. The cylinder 12 is formed in two halves which are designated as 13 and 14. With reference also being made to FIG. 2, the cylinder half 13 is formed with a central circular shaft bore 16 for a drive shaft 17 and three circumferentially spaced circular bores 18, 19 and 21 which extend completely through the cylinder half 13.

The cylinder half 14 is formed with a central shaft bore 22 for the drive shaft 17 and three bores identical to the bores 18, 19 and 21, although only one of these bores is visible in the drawing and designated as 23.

A diagonal swash plate 24 is fixed on the drive shaft 17 for integral rotation. The drive shaft 17 and swash plate 24 are rotatably supported in the cylinder 12 by means of thrust bearings 26 and 27 and radial bearings 28 and 29. The axially inner postions of the cylinder havles 13 and 14 are cut away as indicated at 31 and 32 to allow the swash plate 24 to pass between the openings of the bores 18, 19, 21, and the bore 23 and two non-illustrated bores of the cylinder halves 13 and 14.

A double acting piston 33 is slidably disposed in the bores 18 and 23. The piston 33 is formed with two heads, designated as 34 and 36, which are joined together. The heads 34 and 36 are formed with pockets 37 and 38 for balls 39 and 41 respectively. Shoes 42 and 43 are slidably disposed between the left and right faces of the swash plate 24 and the balls 39 and 41 respectively. Essentially similar pistons are provided in the other two sets of bores, although not illustrated.

Figure 3:
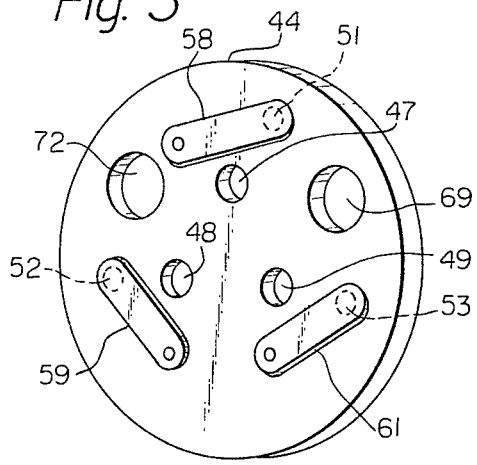
FIG. 3 is a perspective view of a valve plate of the compressor.
Figure 5:
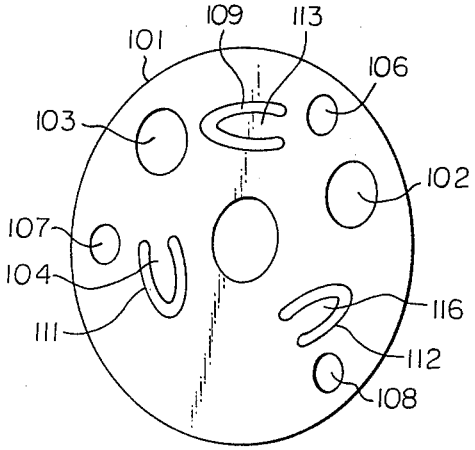
FIG. 5 is a perspective view of an inlet valve plate of the compressor.

Attached to the left and right ends of the cylinder 12 are valve plates 44 and 46 respectively. The valve plate 44 is shown in FIG. 3 as being formed with radially inner inlet ports 47, 48 and 49 and radially outer outlet ports 51, 52 and 53 which open into the bores 18, 19 and 21 respectively. An inlet flapper valve plate 101 shown in FIG. 5 is attached to the valve plate 44 and allows fluid flow through the inlet ports 47, 48 and 49 only into the bores 18, 19 and 21 respectively. Outlet flapper valves 58, 59 and 61 are also mounted on the valve plate 44 and allow fluid flow through the outlet ports 51, 52 and 53 only out of the bores 18, 19 and 21 respectively. The valve plate 46 is formed with an essentially similar valve arrangement including an inlet valve plate 100, although not shown in detail. The valve plate 46 is further formed with an opening 62 for the drive shaft 17.

Figure 4:
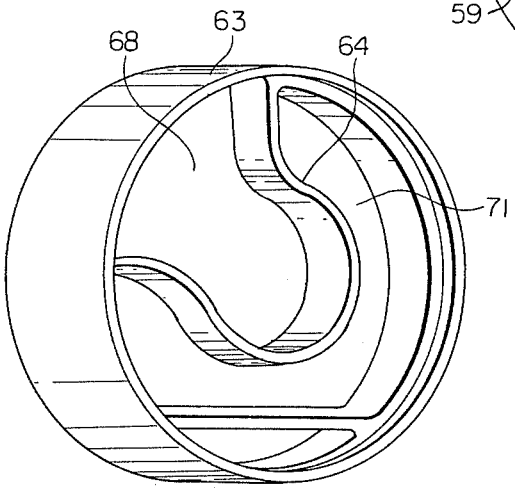
FIG. 4 is a perspective view of a cylinder head of the compressor.

The compressor 11 further comprises a left cylinder head 63 which is shown in FIG. 4. The cylinder head 63 is basically a cap which is attached to and seals the left end of the cylinder 12. However, the cylinder head 63 is formed with a curved partition 64.

As shown in FIG. 2 the cylinder 12 is formed with axial passageways 66 and 67 which extend completely through both cylinder halves 13 and 14. The partition 64 is formed as shown to define an inner inlet chamber 68 which communicates with the bores 18, 19 and 21 through the inlet ports 47, 48 and 49 and also with the passageway 67 through a hole 69 formed through the valve plate 44. The partition 64 also defines an outer oulet chamber 71 which communicates with the bores 18, 19 and 21 through the outlet ports 51, 52 and 53 and also with the passageway 66 through a hole 72 formed through the valve plate 44.

The compressor 11 further comprises a right cylinder head 73 formed with a partition 74 identical to the partition 64. The partition 74 defines an inlet chamber 76 and an outlet chamber 77 which communicate with the bores of the cylinder half 14 through the valves of the valve plate 46. In addition, the inlet and outlet chambers 76 and 77 communicate with the inlet and outlet chambers 68 and 71 through holes (not shown) formed through the valve plate 46 and the passageways 67 and 66 respectively. The inlet chamber 68 is connected to an evaporator of an air conditioning system (not shown) or the like through an inlet connector 78. The outlet chamber 71 is connected to an expansion valve of the air conditioning system through a condenser (not shown). Further illustrated is a seal 79 for the shaft 17.

In operation, the shaft 17 is rotated. Since the swash plate 24 is rigidly mounted on the shaft 17 it also rotates. This causes the piston 33 and the other two non-illustrated pistons to reciprocate once per revolution of the swash plate 24.

As the swash plate 24 approaches the position illustrated in FIG. 1, the piston head 36 displaces refrigerant fluid out of the bore 23 whereas the piston head 34 sucks refrigerant fluid into the bore 18. The inlet valve plate 101 allows fluid flow into the bore 18 whereas the coresponding non-illustrated valve provided to the valve plate 46 allows fluid flow out of the bore 23. As the swash plate 24 is rotated 180° the piston 33 is moved leftwardly so that the piston head 34 displaces fluid out of the bore 18 whereas the piston head 36 sucks fluid into the bore 23. This action causes fluid to be compressively displaced from the inlet chambers 68 and 76 through the bores into the outlet chambers 71 and 77 and thereby through the compressor 11.

As shown in FIG. 5, the flapper valve plate 101 is provided at the valve plate 44 rightwardly thereof and is formed with holes 102 and 103 conjugate to the holes 69 and 72 respectively. The plate 101 is further formed with holes 106, 107 and 108 conjugate to the outlet ports 51, 52 and 53 respectively.

U-shaped holes 109, 111 and 112 are formed through the plate 101 to define inlet flapper valves 113, 114 and 116 which normally cover the inlet ports 47, 48 and 49 respectively.

The plate 101 is formed of a resilient material such as spring steel or the like. Thus, the inlet flapper valves 113, 114 and 116 are deformable by inlet suction to uncover the inlet ports 47, 48 and 49.

The swash plate 24 is partially immersed in lubricant oil in a chamber 81 formed in the lower portion of the cylinder 12. The swash plate 24 splashes oil about the interior of the chambers 31 and 32 to lubricate the various moving parts during operation of the compressor 11.

In accordance with an important feature of the present invention, annular chambers 121 and 122 are defined within the shaft bores 16 and 22 axially adjacent to the right and left ends of the radial bearings 28 and 29 respectively. The bearings 28 and 29 are of the rolling contact type such as ball, roller or needle bearings. Passageways 123 and 124 are formed through the cylinder halves 13 and 14 from the bores 18 and 23 to the chambers 121 and 122 respectively. The chamber 121 and passageway 123 are shown in greater detail in FIG. 6.

During operation of the compressor 11, oil entrained in the refrigerant fluid in the bores 18 and 23 is forced downwardly through the passageways 123 and 124 into the chambers 121 and 122 when the piston 33 compresses refrigerant in the respective bores 18 and 23. The oil passes axially from the chambers 121 and 122 into the bearings 28 and 29 and lubricates the same. Sufficient pressure is created in the bores 18 and 23 even during startup of the compressor 11 to ensure effective lubrication of the bearings 28 and 29.

Figure 6:
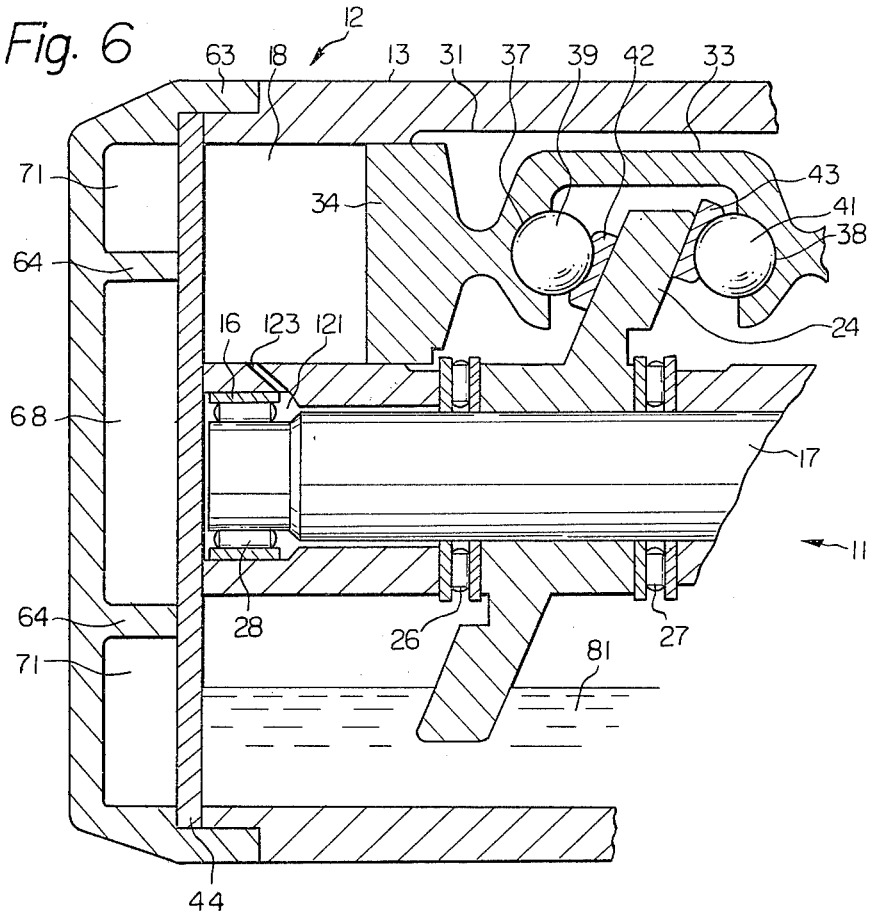
FIG. 6 is an enlarged fragmentary view of the embodiment of FIG. 1.
Figure 7:
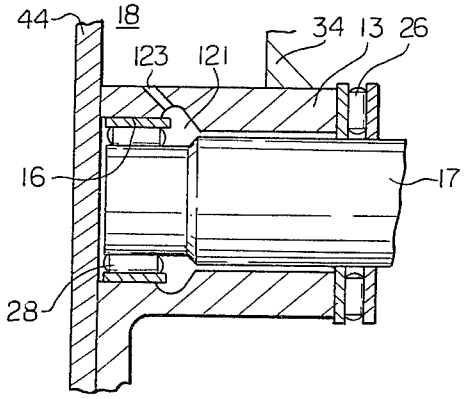
FIG. 7 is a fragmentary sectional view illustrating a modification of the embodiment of FIGS. 1 and 6.

FIG. 7 shows a modification of the embodiment of the FIGS. 1 and 6 in which the chamber 121 is replaced by a radially enlarged annular chamber 121'. Oil caused to flow into the chamber 121' through the passageway 123 during operation of the compressor 11 acculumates in the chamber 121' and remains therein when the compressor 11 is shut down. In this manner, as auxiliary supply of oil is available in the chamber 121' for immediate lubrication of the bearing 28 upon startup of the compressor 11 to supplement the oil flowing through the passageway 123. The chamber 122 is similarly modified although not visible in FIG. 7.

Figure 8:
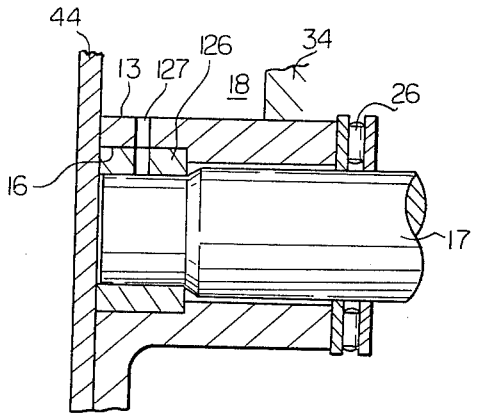
FIG. 8 is similar to FIG. 7 but shows a second embodiment of the present invention.

FIG. 8 shows another embodiment of the present invention in which the rolling contact bearing 28 is replaced by a journal metal bearing 126. In this case a passageway 127 leads from the bore 18 through the bearing 126 to the shaft 17. Oil forced through the passageway 127 enters the space between the bearing 126 and the shaft 17 and thereby provides lubrication of the sliding surfaces.

Figure 9:
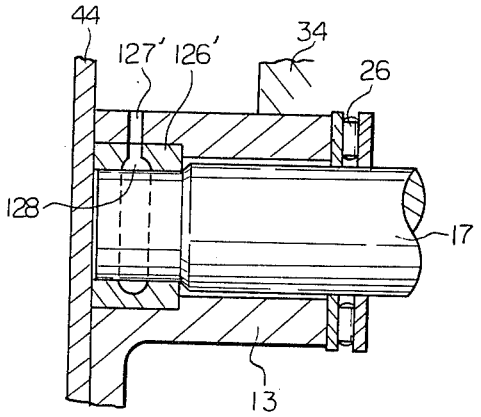
FIG. 9 shows a modification of the embodiment of FIG. 8.

FIG. 9 shows a modification of the embodiment of FIG. 8 in which an annular groove 128 is formed in the inner surface of a bearing 126'. A passageway 127' leads from the bore 18 to the groove 128. The groove 128 serves the dual function of distributing the oil over a larger area of the inner surface of the bearing 126' and storing an auxiliary amount of oil when the compressor 11 is shut down for immediate lubrication of the bearing 126' upon startup.

Figure 10:
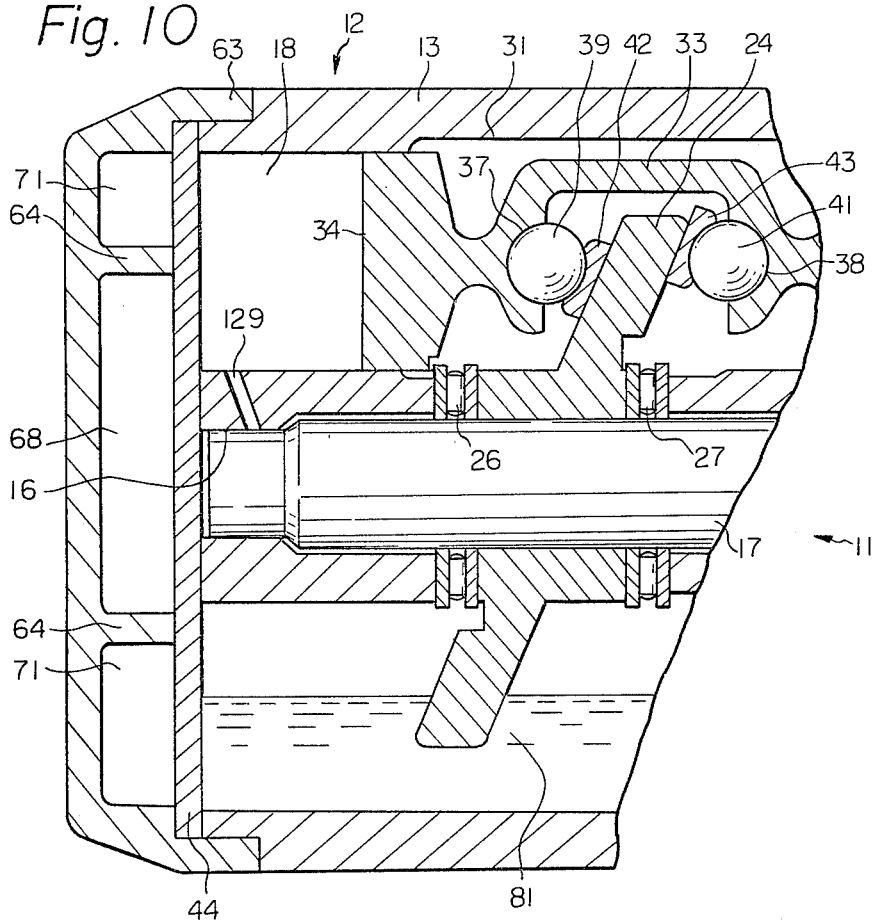
FIG. 10 is similar to FIG. 6 but shows a third embodiment of the present invention.

FIG. 10 illustrates another embodiment of the present invention in which the bearings for the shaft 17 are constituted by the inner surfaces of the shaft bores 16 and 22. The cylinder halves 13 and 14 are in this case formed of a suitable low friction metal. A passageway 129 leads from the bore 18 to the bore 16.

Figure 11:
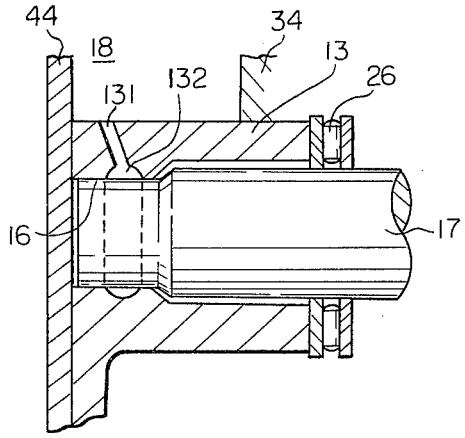
FIG. 11 shows a modification of the embodiment of FIG. 10.

FIG. 11 shows a modification of the embodiment of FIG. 10 in which an annular groove 132 is formed in the inner surface of the shaft bore 16 and a passageway 131 leads from the bore 18 to the groove 132. The groove 132 provides the same functions as the groove 128.

In summary, it will be seen that the present invention overcomes the problems of the prior art and provides a swash plate compressor with simple configuration but improved shaft lubrication.

Various modifications will become possible for those skilled in the art after receiving the teachings of the present disclosure without departing from the scope thereof. For example, the oil passageway 123 may lead from the bore 19 or 21 to the chamber 121 rather than from the bore 18. Although the present invention has been shown and described as relating to a swash plate compressor, it may be applied to other types of reciprocating compressors.

What is claimed is:

1. A compressor including a cylinder formed with a bore, a piston slidably disposed in the bore, bearing means disposed in the cylinder, a shaft rotatably supported in the cylinder by the bearing means and mechanism means correcting the shaft to the piston in such a manner that rotation of the shaft causes reciprocation of the piston, characterized by comprising a passageway connecting the bore to the bearing means in such a manner that fluid and entrained lubricant compressed in the bore by movement of the piston are fed from the bore to the bearing means through the passageway;

the bearing means comprising a journal bearing, the passageway extending radially through the journal bearing.

2. A compressor as in claim 1, in which the mechanism means comprises a swash plate.

3. A compressor as in claim 1, in which the cylinder is formed with a shaft bore, the journal bearing being disposed in the shaft bore.

4. A compressor as in claim 1, in which an inner surface of the journal bearing is formed with an annular groove, the passageway communicating with the annular groove.

* * * * *